US011009269B2

(12) United States Patent
Wakabayashi et al.

(10) Patent No.: US 11,009,269 B2
(45) Date of Patent: May 18, 2021

(54) HEAT CYCLE SYSTEM

(71) Applicant: AGC Inc., Chiyoda-ku (JP)

(72) Inventors: Hisao Wakabayashi, Otsu (JP); Hirokazu Takagi, Chiyoda-ku (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 16/601,753

(22) Filed: Oct. 15, 2019

(65) Prior Publication Data

US 2020/0041174 A1 Feb. 6, 2020

Related U.S. Application Data

(63) Continuation of application No. PCT/JP2018/015463, filed on Apr. 13, 2018.

(30) Foreign Application Priority Data

Apr. 20, 2017 (JP) ..... JP2017-083580

(51) Int. Cl.
*F25B 13/00* (2006.01)
*F25B 49/02* (2006.01)
*F25B 41/40* (2021.01)

(52) U.S. Cl.
CPC ..... *F25B 13/00* (2013.01); *F25B 41/40* (2021.01); *F25B 49/02* (2013.01)

(58) Field of Classification Search
CPC ..... F25B 13/00; F25B 49/02; F25B 41/003; F16L 35/00
See application file for complete search history.

(56) References Cited

U.S. PATENT DOCUMENTS

2013/0074952 A1* 3/2013 Krober ..... F16L 35/00 137/377
2014/0331704 A1 11/2014 Kondrk et al.
2017/0138645 A1* 5/2017 Sakima ..... F25B 45/00

FOREIGN PATENT DOCUMENTS

EP 0997330 A1 * 5/2000 ..... B60H 1/3225
JP 06-020992 A 3/1994
JP 10-047587 A 2/1998
JP 2000-097520 A 4/2000
JP 2000-130896 A 5/2000
JP 2000-346282 A 12/2000
JP 2018-025326 A 2/2018
JP 2018-025372 A 2/2018
(Continued)

OTHER PUBLICATIONS

International Search Report dated Jun. 26, 2018 in PCT/JP2018/015463 filed on Apr. 13, 2018.

*Primary Examiner* — Marc E Norman
*Assistant Examiner* — Schyler S Sanks
(74) *Attorney, Agent, or Firm* — Oblon, McClelland, Maier & Neustadt, L.L.P.

(57) ABSTRACT

The heat cycle system of the present invention is a heat cycle system which employs a working fluid containing trifluoroethylene, comprising a compressor, a condenser, an expansion valve and an evaporator, and further having a circulation flow path and a fragile part. The circulation flow path connects the compressor, the condenser, the expansion valve and the evaporator and circulates the working fluid. The fragile part is provided in the circulation flow path or to the condenser and has a pressure resistance strength lower than the pressure resistance strength of the circulation flow path and the condenser.

11 Claims, 3 Drawing Sheets

(56) References Cited

FOREIGN PATENT DOCUMENTS

| | | | | | |
|---|---|---|---|---|---|
| WO | WO 2012/157764 | A1 | | 11/2012 | |
| WO | WO 2015/140876 | A1 | | 9/2015 | |
| WO | WO 2015/174054 | A1 | | 11/2015 | |
| WO | WO-2015174054 | A1 | * | 11/2015 | ..... F25B 49/005 |
| WO | WO 2017/168503 | A1 | | 10/2017 | |

* cited by examiner

HEAT CYCLE SYSTEM

TECHNICAL FIELD

The present invention relates to a heat cycle system which employs a working fluid containing trifluoroethylene.

BACKGROUND ART

Heretofore, as a working fluid for a heat cycle system such as a latent heat transport apparatus such as a heat pipe, a refrigerator or an air-conditioning apparatus, a hydrofluoroolefin (HFO) having a carbon-carbon double bond has been expected. A HFO is a working fluid having less influence over the ozone layer and having less influence over global warming, since a carbon-carbon double bond is likely to be decomposed by OH radicals in the air.

As a working fluid using a HFO, for example, one using trifluoroethylene has been known. For the purpose of improving nonflammability and cycle performance, it has been attempted to use a working fluid comprising trifluoroethylene and a hydrofluorocarbon by OH radicals in the air.

Further, trifluoroethylene is known to undergo self-decomposition with an ignition source at high temperature or under high pressure, when used alone. Therefore, countermeasures have been taken such that trifluoroethylene is mixed with another component such as vinylidene fluoride to form a mixture having a lowered content of trifluoroethylene.

PRIOR ART DOCUMENTS

Patent Document

Patent Document 1: WO2012/157764

DISCLOSURE OF INVENTION

Technical Problem

Prior to the start of the self-decomposition reaction of trifluoroethylene, it is possible to avoid a high pressure or high temperature state in a heat cycle system for example. Accordingly, it is possible to prevent the self-decomposition from occurring by widening the opening of an expansion valve or by lowering the operating speed of a compressor. In case of further emergency, it is possible to prevent the self-decomposition reaction from occurring by completely opening control valves in a refrigerant circuit or by turning the power off. However, immediately after occurrence of the self-decomposition reaction, the pressure in the refrigerant circuit instantaneously increases to about 10 times the pressure in the ordinary state, and large-scale breakage of the heat cycle system is forecast.

Under these circumstances, the present invention has been made to solve the above problems, and it is an object of the present invention to provide a heat cycle system which can suppress damages when self-decomposition reaction of trifluoroethylene contained in the working fluid occurs.

Solution to Problem

The present invention provides a heat cycle system having the following constitutions [1] to [13].

[1] A heat cycle system which employs a working fluid containing trifluoroethylene, comprising:

a compressor, a condenser, an expansion valve and an evaporator;

a circulation flow path which connects the compressor, the condenser, the expansion valve and the evaporator and circulates the working fluid, and a fragile part, wherein the fragile part is provided in the circulation flow path or to the condenser and has a pressure resistance strength lower than the pressure resistance strength of the circulation flow path and the condenser.

[2] The heat cycle system according to Claim 1, wherein the fragile part is provided in the circulation flow path connecting the compressor and the condenser or in the circulation flow path connecting the condenser and the expansion valve.

[3] The heat cycle system according to Claim 1 or 2, wherein the circulation flow path connecting the compressor and the condenser has a four-way valve, and the fragile part is provided in the circulation flow path connecting the compressor and the four-way valve.

[4] The heat cycle system according to any one of Claims 1 to 3, wherein the fragile part is broken by a pressure generated when self-decomposition reaction of trifluoroethylene occurs in the circulation flow path to release the pressure to the outside of the circulation flow path.

[5] The heat cycle system according to any one of Claims 1 to 4, wherein the pressure resistance strength of the fragile part is within a range of at least 70% and at most 90% based on the pressure resistance strength of the circulation flow path and the condenser being 100%.

[6] The heat cycle system according to any one of Claims 1 to 5, wherein the pressure resistance strength of the fragile part is within a range of at least 1.5 times and at most 3 times the design pressure of the heat cycle system.

[7] The heat cycle system according to any one of Claims 1 to 6, wherein the fragile part is made from a constituent material having a tensile strength lower than the constituent material of the circulation flow path.

[8] The heat cycle system according to any one of Claims 1 to 7, wherein the thickness of the fragile part is smaller than the thickness of the circulation flow path.

[9] The heat cycle system according to any one of Claims 1 to 8, which further has a protection part.

[10] The heat cycle system according to Claim 9, wherein the protection part has a mesh-form member.

[11] The heat cycle system according to Claim 9 or 10, wherein the protection part further has a porous adsorption member.

[12] The heat cycle system according to any one of Claims 1 to 11, wherein the condenser and the fragile part are built into an outdoor unit, and the fragile part is disposed selectively at a position facing the condenser.

[13] The heat cycle system according to any one of Claims 1 to 12, wherein the content of trifluoroethylene in 100 mass % of the working fluid is higher than 50 mass % and at most 100 mass %.

Advantageous Effects of Invention

According to the present invention, it is possible to provide a heat cycle system which can suppress damages when self-decomposition reaction of trifluoroethylene contained in the working fluid occurs.

DESCRIPTION OF EMBODIMENTS

Now, embodiments of the present invention will be described with reference to drawings.

Figure 1:
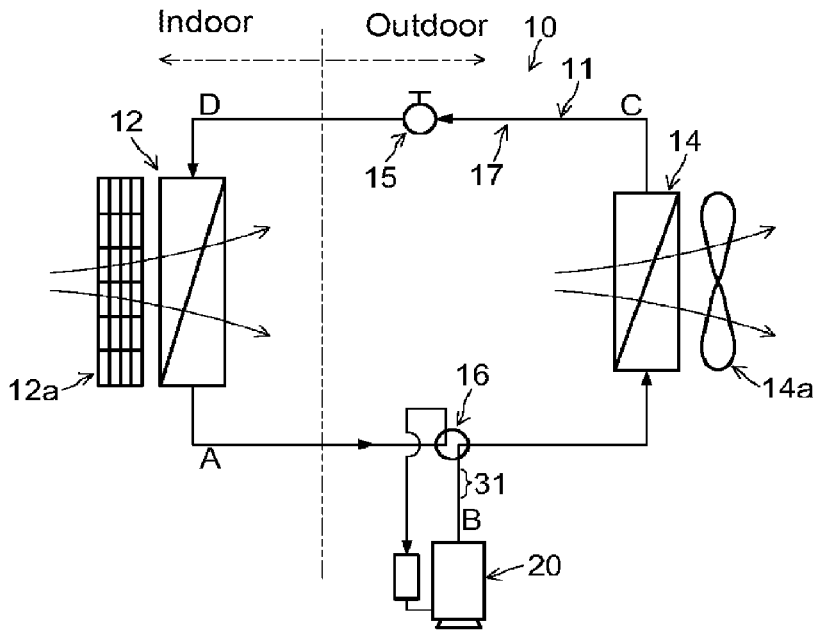
FIG. 1 is a view schematically illustrating the structure of a heat cycle system according to an embodiment of the present invention.

As shown in FIG. 1, a heat cycle system 10 according to the present embodiment is an air-conditioning system having a cooling and heating function employing a working fluid (refrigerant) containing trifluoroethylene (HFO-1123). The heat cycle system 10 mainly comprises a compressor 20, an outdoor heat exchanger (condenser or evaporator) 14, an expansion valve 15, an indoor heat exchanger (evaporator or condenser) 12, a four-way valve 16 and a circulation flow path 17, and has a working fluid 11 enclosed therein. In FIG. 1, the direction of the flow of the working fluid 11 along the circulation flow path 17 at the time of cooling is represented by arrows.

The working fluid 11 preferably has a content of trifluoroethylene of higher than 50 mass % and at most 100 mass % based on its entire amount. In this specification, unless otherwise specified, a HFC means a hydrofluorocarbon which is a compound having one or more of hydrogen atoms in a saturated hydrocarbon substituted by a fluorine atom and is distinguished from a hydrofluoroolefin (HFO) constituted by carbon atoms, hydrogen atoms and fluorine atoms and having a carbon-carbon double bond. Further, a HFC may be referred to as a saturated hydrofluorocarbon in some cases. Further, abbreviated names of halogenated hydrocarbon compounds such as HFCs and HFOs are described in brackets after the compound names, and in this specification, the abbreviated names are employed instead of the compound names as the case requires.

As shown in FIG. 1, the circulation flow path 17 connects the compressor 20, the outdoor heat exchanger (condenser or evaporator) 14, the expansion valve 15, and the indoor heat exchanger (evaporator or condenser) 12 and circulates the working fluid 11. The four-way valve 16 is provided in the circulation flow path 17 connecting the compressor 20, and the outdoor heat exchanger 14 and the indoor heat exchanger 12. The four-way valve 16 changes the direction of the flow of the working fluid 11 circulating in the circulation flow path 17. At the time of cooling, the outdoor heat exchanger 14 functions as a condenser and the indoor heat exchanger 12 functions as an evaporator. On the other hand, at the time of heating, the outdoor heat exchanger 14 functions as an evaporator and the indoor heat exchanger 12 functions as a condenser.

That is, at the time of cooling, the circulation flow path 17 makes the working fluid 11 circulate from the compressor 20 via the four-way valve 16, the outdoor heat exchanger (condenser) 14, the expansion valve 15, the indoor heat exchanger (evaporator) 12 and the four-way valve 16 in order to the compressor 20. On the other hand, at the time of heating, the circulation flow path 17 makes the working fluid 11 circulate from the compressor 20 via the four-way valve 16, the indoor heat exchanger (condenser) 12, the expansion valve 15, the outdoor heat exchanger (evaporator) 14 and the four-way valve 16 in order to the compressor 20.

More particularly, as shown in FIG. 1, at the time of cooling, the compressor 20 draws, compresses and forms the working fluid 11 in a vapor A state into a high temperature/high pressure vapor B. The working fluid 11 in the vapor B form is led via the four-way valve 16 to the outdoor heat exchanger (condenser) 14, releases heat to the surrounding air, is cooled and liquefied by an air from an outdoor fan 14*a* and is formed into a low temperature/high pressure liquid state C. The working fluid 11 in a liquid state C which flows into the expansion valve 15 is subjected to expansion/pressure reduction to be formed into a low temperature/low pressure gaseous/liquid phase state D. The working fluid 11 (state D) led to the indoor heat exchanger (evaporator) 12 absorbs heat from the surrounding air, is heated and evaporated by an air from an indoor fan 12*a*, is formed into a low temperature/low pressure vapor A and returns to the compressor 20 via the four-way valve 16.

Figure 2:
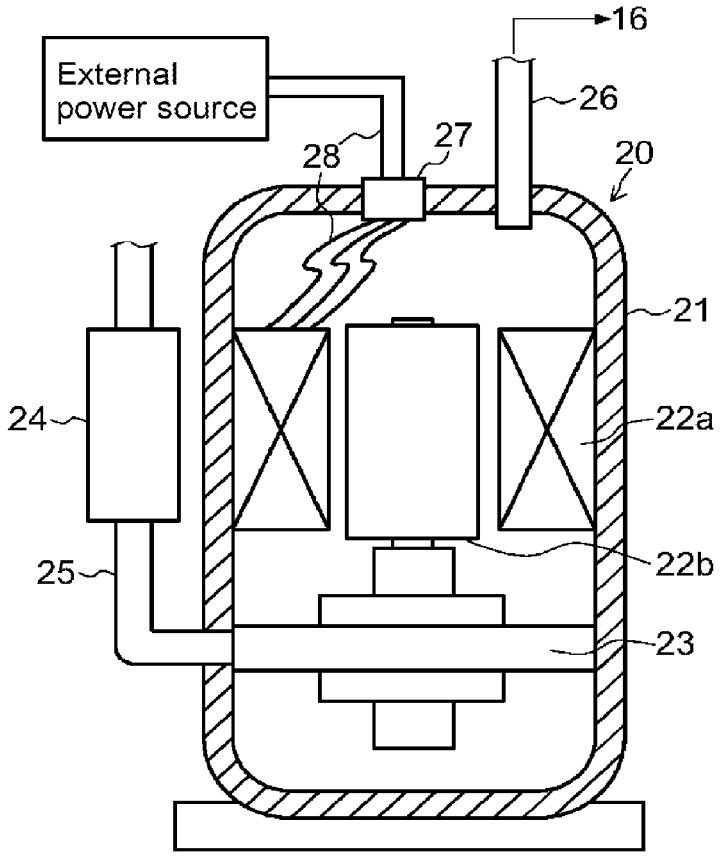
FIG. 2 is a view illustrating the structure of a compressor in the heat cycle system in FIG. 1.

As shown in FIG. 2, a hermetic type compressor 20 having a built-in motor is a scroll compressor comprising a closed container 21, a motor stator 22*a*, a motor rotor 22*b*, a scroll compression mechanism 23, an accumulator 24, a suction pipe 25, a delivery pipe 26, a power supply terminal 27 and a power supply path 28, and an electric power is supplied from an external power source shown in the drawing.

The scroll compression mechanism 23 comprises two spiral structures (not shown) facing and being interlocked with each other to form a space, driven by rotation of the motor rotor 22*b* to change the volume of the space thereby to compress the working fluid 11. The accumulator 24 and the suction pipe 25 are connected to the closed container 21 and introduce (draw) the working fluid 11 into the scroll compression mechanism 23. The working fluid 11 compressed in the scroll compression mechanism 23 is discharged into the closed container, and flows via the delivery pipe 26 and the four-way valve 16 into the condenser (the outdoor heat exchanger 14 at the time of cooling or the indoor heat exchanger 12 at the time of heating). As the power supply to the compressor 20, the electric power is supplied from the external power source vie the power supply terminal 27 and the power supply path 28 to the motor stator 22*a*.

Here, a scroll compressor is shown as an example, however, a known compressor may be used without any restrictions. For example, a reciprocating compressor, a swash plate compressor, a rotary compressor or a centrifugal compressor may, for example, be used instead of the scroll compressor.

The above-described working fluid is a mixed fluid containing HFO-1123 and other working fluid. Here, the global warming potential (100 years) of HFO-1123 is 0.3 as a value measured in accordance with Intergovernmental Panel on Climate Change (IPCC), Fourth assessment report. In this specification, unless otherwise specified, GWP is a value specified here.

In such a manner, the working fluid is preferably one containing HFO-1123 having a very low GWP in an amount of larger than 50 mass %, thereby having GWP suppressed low. In a case where the working fluid contains the after-described optional component, when GWP of the optional component is higher than that of HFO-1123, for example, as in the case of the after-described saturated HFC, the lower its content is, the lower GWP can be suppressed to be low.

HFO-1123 used for the working fluid may undergo chain self-decomposition reaction with an ignition source at high temperature or under high pressure, when its content is high in the working fluid. Although the self-decomposition reaction can be suppressed by lowering the content of HFO-1123 in the working fluid, if the content is too low, GWP tends to increase, and the refrigerating capacity and the coefficient of performance tend to decrease in many cases, although it depends on other working fluid to be used in combination.

In application of the working fluid to the heat cycle system according to the present embodiment, the content of HFO-1123 in100 mass % of the working fluid is preferably higher than 50 mass %, more preferably higher than 60 mass %, further preferably higher than 70 mass %. By such a content, GWP will be sufficiently low, and a favorable refrigerating capacity can be secured.

<Optional Component>

The working fluid may contain as an optional component a compound commonly used for a working fluid in addition to HFO-1123 within a range not to impair effects of the present invention. The optional component is preferably a HFC or a HFO other than HFO-1123.

<HFC>

As the HFC, for example, a HFC having an effect to decrease the temperature glide, an effect to improve the capacity or an effect to further increase the efficiency, when used for heat cycle in combination with HFO-1123, is used. When the working fluid for heat cycle used in the present invention contains such a HFC, more favorable cycle performance will be obtained.

A HFC is known to have a high GWP as compared with HFO-1123. Accordingly, a HFC is selected with a view to adjusting the GWP within an acceptable range, in addition to improving cycle performance as the working fluid.

A HFC which has less influence over the ozone layer and which has less influence over global warming, is specifically preferably a $C_{1-5}$ HFC. The HFC may be linear, branched or cyclic.

The HFC may, for example, be difluoromethane (HFC-32), difluoroethane, trifluoroethane, tetrafluoroethane, pentafluoroethane (HFC-125), pentafluoropropane, hexafluoropropane, heptafluoropropane, pentafluorobutane or heptafluorocyclopentane.

Particularly, in view of less influence over the ozone layer and excellent refrigerating cycle performance, the HFC is preferably HFC-32, 1,1-difluoroethane (HFC-152a), 1,1,1-trifluoroethane (HFC-143a), 1,1,2,2-tetrafluoroethane (HFC-134), 1,1,1,2-tetrafluoroethane (HFC-134a) or HFC-125, more preferably HFC-32, HFC-134a or HFC-125. The HFC may be used alone or in combination of two or more.

Here, with respect to GWPs of the above preferred HFCs, GWP of HFC-32 is 675, GWP of HFC-134a is 1,430, and GWP of HFC-125 is 3,500. With a view to keeping GWP of the obtainable working fluid low, the HFC as an optional component is most preferably HFC-32.

<HFO Other than HFO-1123>

The HFO other than HFO-1123 may, for example, be 2,3,3,3-tetrafluoro-1-propene (HFO-1234yf), trans-1,2-difluoroethylene (HFO-1132(E)), cis-1,2-difluoroethylene (HFO-1132(Z)), 2-fluoropropene (HFO-1261yf), 1,1,2-trifluoropropene (HFO-1243yc), trans-1,2,3,3,3-pentafluoropropene (HFO-1225ye(E)), cis-1,2,3,3,3-pentafluoropropene (HFO-1225ye(Z)), trans-1,3,3,3-tetrafluoropropene (HFO-1234ze(E)), cis-1,3,3,3-tetrafluoropropene (HFO-1234ze(Z)) or 3,3,3-trifluoropropene (HFO-1243zf).

Particularly, in view of a high critical temperature, excellent safety and excellent coefficient of performance, the HFO other than HFO-1123 is preferably HFO-1234yf, HFO-1234ze(E) or HFO-1234ze(Z). The HFO other than HFO-1123 may be used alone or in combination of two or more.

In a case where the working fluid contains the HFC and/or the HFO other than HFO-1123, as an optional component, the total content of the HFC and the HFO other than HFO-1123 in 100 mass % of the working fluid is preferably at most 50 mass %, more preferably higher than 0 mass % and at most 40 mass %, most preferably higher than 0 mass % and at most 30 mass %. The total content of the HFC and the HFO other than HFO-1123 in the working fluid is properly adjusted within the above range depending upon the type of the HFC and the HFO other than HFO-1123 used. On that occasion, the total content is adjusted with a view to decreasing the temperature glide, improving the capacity or further improving the efficiency, when used in combination with HFO-1123 for heat cycle, and further considering the global warming potential.

<Other Optional Component>

The working fluid may contain, other than the above optional component, carbon dioxide, a hydrocarbon, a chlorofluoroolefin (CFO), a hydrochlorofluoroolefin (HCFO) or the like, as other optional component. Such other optional component is preferably a component which has less influence over the ozone layer and which has less influence over global warming.

The hydrocarbon may, for example, be propane, propylene, cyclopropane, butane, isobutane, pentane or isopentane. The hydrocarbon may be used alone or in combination of two or more.

In a case where the working fluid contains a hydrocarbon, its content is preferably at most 10 mass %, more preferably from 1 to 10 mass %, further preferably from 1 to 7 mass %, most preferably from 2 to 5 mass % per 100 mass % of the working fluid. When the content of the hydrocarbon is at least the lower limit value, the solubility of a mineral refrigerant oil in the working fluid will be more favorable.

The chlorofluoroolefin (CFO) may, for example, be chlorofluoroethylene or chlorofluoropropene. With a view to suppressing flammability of the working fluid without significantly decreasing the cycle performance of the working fluid for heat cycle of the present invention, the CFO is preferably 1,1-dichloro-2,3,3,3-tetrafluoropropene (CFO-1214ya), 1,3-dichloro-1,2,3,3-tetrafluoropropene (CFO-1214yb) or 1,2-dichloro-1,2-difluoroethylene (CFO-1112). The CFO may be used alone or in combination of two or more.

In a case where the working fluid contains the CFO, its content is preferably at most 50 mass %, more preferably higher than 0 mass % and at most 40 mass %, most preferably higher than 0 mass % and at most 30 mass % per 100 mass % of the working fluid. When the content of the CFO is higher than the lower limit value, the flammability of the working fluid is likely to be suppressed. When the content of the CFO is at most the upper limit value, favorable cycle performance is likely to be obtained.

The HCFO may, for example, be hydrochlorofluoropropene or hydrochlorofluoroethylene. With a view to suppressing the flammability of the working fluid without significantly decreasing the cycle performance of the working fluid for heat cycle used in the present invention, the HCFO is preferably 1-chloro-2,3,3,3-tetrafluoropropene (HCFO-1224yd) or 1-chloro-1,2-difluoroethylene (HCFO-1122).

The HCFO may be used alone or in combination of two or more.

In a case where the working fluid contains the HCFO, the content of the HCFO per 100 mass % of the working fluid is preferably at most 50 mass %, more preferably higher than 0 mass % and at most 40 mass %, most preferably higher than 0 mass % and at most 30 mass %. When the content of the HCFO is higher than the lower limit value, the flammability of the working fluid is likely to be suppressed. When the content of the HCFO is at most the upper limit value, favorable cycle performance is likely to be obtained.

In a case where the working fluid contains the above optional component and other optional component, their total content is preferably at most 50 mass % per 100 mass % of the working fluid.

The above-described working fluid contains HFO-1123 which is a HFO having less influence over global warming and which is excellent in the capacity as a working fluid, and has practical cycle performance while its influence over global warming is suppressed.

<Composition for Heat Cycle System>

The above working fluid is usually mixed with a refrigerant oil to form a composition for a heat cycle system used in the heat cycle system. Such a composition for a heat cycle system is used as enclosed in the circulation flow path of the heat cycle system. The composition for a heat cycle system may further contain a known additive such as a stabilizer or a leak detecting substance, in addition of the refrigerant oil.

<Refrigerant Oil>

As a refrigerant oil, a known refrigerant oil which has been used for the composition for a heat cycle system together with a conventional working fluid comprising a halogenated hydrocarbon may be used without any particular restrictions. The refrigerant oil may, for example, be specifically an oxygen-containing refrigerant oil (such as an ester refrigerant oil or an ether refrigerant oil), a fluorinated refrigerant oil, a mineral refrigerant oil or a hydrocarbon refrigerant oil.

The ester refrigerant oil may, for example, be a dibasic acid ester oil, a polyol ester oil, a complex ester oil or a polyol carbonate oil.

The dibasic acid ester oil is preferably an ester of a $C_{5-10}$ dibasic acid (such as glutaric acid, adipic acid, pimelic acid, suberic acid, azelaic acid or sebacic acid) with a $C_{1-15}$ monohydric alcohol which is linear or has a branched alkyl group (such as methanol, ethanol, propanol, butanol, pentanol, hexanol, heptanol, octanol, nonanol, decanol, undecanol, dodecanol, tridecanol, tetradecanol or pentadecanol). The dibasic acid ester oil may, for example, be specifically ditridecyl glutarate, di(2-ethylhexyl) adipate, diisodecyl adipate, ditridecyl adipate or di(3-ethylhexyl) sebacate.

The polyol ester oil is preferably an ester of a diol (such as ethylene glycol, 1,3-propanediol, propylene glycol, 1,4-butanediol, 1,2-butandiol, 1,5-pentadiol, neopentyl glycol, 1,7-heptanediol or 1,12-dodecanediol) or a polyol having from 3 to 20 hydroxy groups (such as trimethylolethane, trimethylolpropane, trimethylolbutane, pentaerythritol, glycerol, sorbitol, sorbitan or sorbitol/glycerin condensate) with a $C_{6-20}$ fatty acid (such as a linear or branched fatty acid such as hexanoic acid, heptanoic acid, octanoic acid, nonanoic acid, decanoic acid, undecanoic acid, dodecanoic acid, eicosanoic acid or oleic acid, or a so-called neo acid having a quaternary a carbon atom). The polyol ester oil may have a free hydroxy group.

The polyol ester oil is preferably an ester (such as trimethylolpropane tripelargonate, pentaerythritol 2-ethylhexanoate or pentaerythritol tetrapelargonate) of a hindered alcohol (such as neopentyl glycol, trimethylolethane, trimethylolpropane, trimethylolbutane or pentaerythritol).

The complex ester oil is an ester of a fatty acid and a dibasic acid, with a monohydric alcohol and a polyol. The fatty acid, the dibasic acid, the monohydric alcohol and the polyol may be as defined above.

The polyol carbonate oil is an ester of carbonic acid with a polyol. The polyol may be the above-described diol or the above-described polyol. Further, the polyol carbonate oil may be a ring-opening polymer of a cyclic alkylene carbonate.

The ether refrigerant oil may be a polyvinyl ether oil or a polyoxyalkylene oil. The polyvinyl ether oil may be a polymer obtained by polymerizing a vinyl ether monomer such as an alkyl vinyl ether, or a copolymer obtained by copolymerizing a vinyl ether monomer and a hydrocarbon monomer having an olefinic double bond. The vinyl ether monomer may be used alone or in combination of two or more.

The hydrocarbon monomer having an olefinic double bond may, for example, be ethylene, propylene, a butene, a pentene, a hexene, a heptene, an octene, diisobutylene, triisobutylene, styrene, a-methylstyrene or an alkyl-substituted styrene. The hydrocarbon monomer having an olefinic double bond may be used alone or in combination of two or more.

The polyvinyl ether copolymer may be either of a block copolymer and a random copolymer. The polyvinyl ether oil may be used alone or in combination of two or more.

The polyoxyalkylene oil may, for example, be a polyoxyalkylene monool, a polyoxyalkylene polyol, an alkyl ether of a polyoxyalkylene monool or a polyoxyalkylene polyol, or an ester of a polyoxyalkylene monool or a polyoxyalkylene polyol.

The polyoxyalkylene monool or the polyoxyalkylene polyol may be one obtained by e.g. a method of subjecting a $C_{2-4}$ alkylene oxide (such as ethylene oxide or propylene oxide) to ring-opening addition polymerization to an initiator such as water or a hydroxy group-containing compound in the presence of a catalyst such as an alkali hydroxide. Further, one molecule of the polyoxyalkylene chain may contain single oxyalkylene units or two or more types of oxyalkylene units. It is preferred that at least oxypropylene units are contained in one molecule.

The initiator to be used for the reaction may, for example, be water, a monohydric alcohol such as methanol or butanol, or a polyhydric alcohol such as ethylene glycol, propylene glycol, pentaerythritol or glycerol.

The polyoxyalkylene oil is preferably an alkyl ether or ester of a polyoxyalkylene monool or polyoxyalkylene polyol. Further, the polyoxyalkylene polyol is preferably a polyoxyalkylene glycol. Particularly preferred is an alkyl ether of a polyoxyalkylene glycol having the terminal hydroxy group of the polyoxyalkylene glycol capped with an alkyl group such as a methyl group, which is called a polyglycol oil.

The fluorinated refrigerant oil may, for example, be a compound having hydrogen atoms of a synthetic oil (such as the after-mentioned mineral oil, poly-α-olefin, alkylbenzene or alkylnaphthalene) substituted by fluorine atoms, a perfluoropolyether oil or a fluorinated silicone oil.

The mineral refrigerant oil may, for example, be a naphthene mineral oil or a paraffin mineral oil obtained by purifying a refrigerant oil fraction obtained by atmospheric distillation or vacuum distillation of crude oil by a purification treatment such as solvent deasphalting, solvent extraction, hydrocracking, solvent dewaxing, catalytic dewaxing, hydrotreating or clay treatment optionally in combination.

The hydrocarbon refrigerant oil may, for example, be a poly-α-olefin, an alkylbenzene or an alkylnaphthalene.

The refrigerant oil may be used alone or in combination of two or more. The refrigerant oil is preferably at least one member selected from a polyol ester oil, a polyvinyl ether oil and a polyglycol oil in view of compatibility with the working fluid. The amount of the refrigerant oil is not limited within a range not to remarkably decrease the effects of the present invention, and is preferably from 10 to 100 parts by mass, more preferably from 20 to 50 parts by mass, per 100 parts by mass of the working fluid.

<Stabilizer>

The stabilizer is a component which improves the stability of the working fluid against heat and oxidation. As the stabilizer, a known stabilizer which has been used for a heat cycle system together with a working fluid comprising a halogenated hydrocarbon, for example, an oxidation resistance-improving agent, a heat resistance-improving agent or a metal deactivator, may be used without any particular restrictions.

The oxidation resistance-improving agent and the heat resistance-improving agent may, for example, be N,N'-diphenylphenylenediamine, p-octyldiphenylamine, p,p'-dioctyldiphenylamine, N-phenyl-1-naphthyamine, N-phenyl-2-naphthylamine, N-(p-dodecyl)phenyl-2-naphthylamine, di-1-naphthylamine, di-2-naphthylamine, N-alkylphenothiazine, 6-(t-butyl)phenol, 2,6-di-(t-butyl)phenol, 4-methyl-2,6-di-(t-butyl)phenol or 4,4'-methylenebis(2,6-di-t-butylphenol). Each of the oxidation resistance-improving agent and the heat resistance-improving agent may be used alone or in combination of two or more.

The metal deactivator may, for example, be imidazole, benzimidazole, 2-mercaptobenzothiazole, 2,5-dimercaptothiadiazole, salicylidene-propylenediamine, pyrazole, benzotriazole, tritriazole, 2-methylbenzamidazole, 3,5-dimethylpyrazole, methylenebis-benzotriazole, an organic acid or an ester thereof, a primary, secondary or tertiary aliphatic amine, an amine salt of an organic acid or inorganic acid, a heterocyclic nitrogen-containing compound, an amine salt of an alkyl phosphate, or a derivative thereof.

The amount of the stabilizer is not limited within a range not to remarkably decrease the effects of the present invention, and is preferably at most 5 parts by mass, more preferably at most 1 part by mass per 100 parts by mass of the working fluid.

<Leak Detecting Substance>

The leak detecting substance may, for example, be an ultraviolet fluorescent dye, an odor gas or an odor masking agent.

The ultraviolet fluorescent dye may be known ultraviolet fluorescent dyes which have been used for a heat cycle system together with a working fluid comprising a halogenated hydrocarbon, such as dyes as disclosed in e.g. U.S. Pat. No. 4,249,412, JP-A-H10-502737, JP-A-2007-511645, JP-A-2008-500437 and JP-A-2008-531836.

The odor masking agent may be known perfumes which have been used for a heat cycle system together with a working fluid comprising a halogenated hydrocarbon, such as perfumes as disclosed in e.g. JP-A-2008-500437 and JP-A-2008-531836.

In a case where the leak detecting substance is used, a solubilizing agent which improves the solubility of the leak detecting substance in the working fluid may be used. The solubilizing agent may be ones as disclosed in e.g. JP-A-2007-511645, JP-A-2008-500437 and JP-A-2008-531836.

The amount of the leak detecting substance is not particularly limited within a range not to remarkably decrease the effects of the present invention, and is preferably at most 2 parts by mass, more preferably at most 0.5 part by mass per 100 parts by mass of the working fluid.

<Heat Cycle System>

Now, the heat cycle system of the present invention employing the above working fluid for heat cycle will be described. The heat cycle system is a system employing a working fluid containing HFO-1123 as a working fluid for heat cycle. When the working fluid for heat cycle is applied to a heat cycle system, usually it is applied as a composition for a heat cycle system containing the working fluid.

Further, the heat cycle system of the present invention may be one of which the constitution of the basic heat cycle is the same as a conventionally known heat cycle system, and the heat cycle system of the present invention may be a heat pump system utilizing heat obtained by a condenser or may be a refrigerating cycle system utilizing coldness obtained by an evaporator.

Such a heat cycle system may, for example, be specifically a refrigerating apparatus, an air-conditioning apparatus, a power generation system, a heat transfer apparatus or a secondary cooling machine. Among them, the heat cycle system of the present invention, which stably exhibits heat cycle performance in a working environment at higher temperature, is preferably employed as an air-conditioning apparatus to be disposed outdoors in many cases. Further, the heat cycle system of the present invention is preferably employed also for a refrigerating apparatus.

The air-conditioning apparatus may, for example, be specifically a room air-conditioner, a package air-conditioner (such as a store package air-conditioner, a building package air-conditioner or a plant package air-conditioner), a gas engine heat pump, a train air-conditioning system or an automobile air-conditioning system.

The refrigerating apparatus may, for example, be specifically a showcase (such as a built-in showcase or a separate showcase), an industrial fridge freezer, a vending machine or an ice making machine.

The power generation system is preferably a power generation system by Rankine cycle system. The power generation system may, for example, be specifically a system wherein in an evaporator, a working fluid is heated by e.g. geothermal energy, solar heat or waste heat in a medium-to-high temperature range at a level of from 50 to 200° C., and the vaporized working fluid in a high temperature and high pressure state is adiabatically expanded by an expansion device, so that a power generator is driven by the work generated by the adiabatic expansion to carry out power generation.

Further, the heat cycle system of the present invention may be a heat transport apparatus. The heat transport apparatus is preferably a latent heat transport apparatus.

The latent heat transport apparatus may, for example, be a heat pipe conducting latent heat transport utilizing evaporation, boiling, condensation, etc. of a working fluid filled in an apparatus, and a two-phase closed thermosiphon. A heat pipe is applied to a relatively small-sized cooling apparatus such as a cooling apparatus of a heating portion of a semiconductor device and electronic equipment. A two-phase closed thermosiphon is widely used for a gas/gas heat exchanger, to accelerate snow melting and to prevent freezing of roads, since it does not require a wick and its structure is simple.

<Moisture Concentration>

At the time of operation of the heat cycle system, in order to avoid drawbacks due to inclusion of moisture or inclusion of non-condensing gas such as oxygen, it is preferred to provide a means to suppress such inclusion.

If moisture is included in the heat cycle system, a problem may occur particularly when the heat cycle system is used at low temperature. For example, problems such as freezing in a capillary tube, hydrolysis of the working fluid or the refrigerant oil, deterioration of materials by an acid component formed in the cycle, formation of contaminants, etc. may arise. Particularly, if the refrigerant oil is a polyglycol oil or a polyol ester oil, it has extremely high moisture absorbing properties and is likely to undergo hydrolysis, and inclusion of moisture decreases properties of the refrigerant oil and may be a great cause to impair the long term reliability of a compressor. Accordingly, in order to suppress hydrolysis of the refrigerant oil, it is necessary to control the moisture concentration in the heat cycle system.

As a method of controlling the moisture concentration in the heat cycle system, a method of using a moisture-removing means such as a desiccating agent (such as silica gel, activated aluminum, zeolite or lithium chloride) may be mentioned.

The desiccating agent is preferably brought into contact with the working fluid in a liquid state, in view of the dehydration efficiency. For example, the desiccating agent is preferably located at the inlet of the expansion valve 15 to be brought into contact with the working fluid. The desiccating agent is preferably a zeolite desiccating agent in view of chemical reactivity of the desiccating agent and the working fluid, and the moisture absorption capacity of the desiccating agent.

The zeolite desiccating agent is, in a case where a refrigerant oil having a large moisture absorption as compared with a conventional mineral refrigerant oil is used, preferably a zeolite desiccating agent containing a compound represented by the following formula [1] as the main component in view of excellent moisture absorption capacity.

$$M_{2/n}O \cdot Al_2O_3 \cdot xSiO_2 \cdot yH_2O \quad [1]$$

wherein M is a group 1 element such as Na or K or a group 2 element such as Ca, n is the valence of M, and x and y are values determined by the crystal structure. The pore size can be adjusted by changing M. To select the desiccating agent, the pore size and the fracture strength are important.

In a case where a desiccating agent having a pore size larger than the molecular size of the working fluid is used, the working fluid is adsorbed in the desiccating agent and as a result, chemical reaction between the working fluid and the desiccating agent will occur, thus leading to undesired phenomena such as formation of non-condensing gas, a decrease in the strength of the desiccating agent, and a decrease in the adsorption capacity.

The molecular size of water is about 3 Å, and as the desiccating agent, it is preferred to use a zeolite desiccating agent having a pore size of from about 3 to about 4 Å, particularly preferably sodium/potassium type A synthetic zeolite, whereby it is possible to selectively adsorb and remove only moisture in the heat cycle system without adsorbing the working fluid, and heat decomposition of the working fluid is less likely to occur and as a result, deterioration of materials constituting the heat cycle system and formation of contaminants can be suppressed.

The physical size of the zeolite desiccating agent is preferably from about 0.5 to about 5 mm, since if it is too small, a valve or a thin portion in pipelines of the heat cycle system may be clogged, and if it is too large, the drying capacity will be decreased. Its shape is preferably granular or cylindrical.

The zeolite desiccating agent may be formed into an optional shape by solidifying powdery zeolite by a binding agent (such as bentonite). So long as the desiccating agent is composed mainly of the zeolite desiccating agent, other desiccating agent (such as silica gel or activated alumina) may be used in combination. The proportion of the zeolite desiccating agent based on the working fluid is not particularly limited.

The moisture concentration in the heat cycle system is preferably less than 10,000 ppm, more preferably less than 1,000 ppm, particularly preferably less than 100 ppm, by the mass ratio based on the working fluid for heat cycle.

<Non-Condensing Gas Concentration>

If non-condensing gas is included in the heat cycle system, it has adverse effects such as heat transfer failure in the condenser or the evaporator and resulting increase in the working pressure, and it is necessary to suppress its inclusion as far as possible. Particularly, oxygen which is one of non-condensing gases reacts with the working fluid or the refrigerant oil and promotes their decomposition.

The non-condensing gas concentration is preferably less than 10,000 ppm, more preferably less than 1,000 ppm, particularly preferably less than 100 ppm by the mass ratio based on the working fluid for heat cycle.

<Chlorine Concentration>

If chlorine is present in the heat cycle system, it has adverse effects such as formation of a deposit by a reaction with a metal, friction of a bearing of the compressor, and decomposition of the working fluid for heat cycle or the refrigerant oil. The chlorine concentration in the heat cycle system is preferably at most 100 ppm, particularly preferably at most 50 ppm by the mass ratio based on the working fluid for heat cycle.

<Metal Concentration>

If a metal such as palladium, nickel or iron is present in the heat cycle system, it has adverse effects such as decomposition or oligomerization of HFO-1123. The metal concentration in the heat cycle system is preferably at most 5 ppm, particularly preferably at most 1 ppm by the mass ratio based on the working fluid for heat cycle.

<Acid Concentration>

If an acid is present in the heat cycle system, it has adverse effects such as oxidative destruction or acceleration of self-decomposition reaction of HFO-1123. The acid concentration in the heat cycle system is preferably at most 1 ppm, particularly preferably at most 0.2 ppm by the mass ratio based on the working fluid for heat cycle.

Further, it is preferred to provide a means to remove an acid content by a deoxidizing agent such as NaF in the heat cycle system, for the purpose of removing the acid content from the composition for heat cycle, thereby to remove the acid content from the heat cycle composition.

<Residue Concentration>

If a residue such as a metal powder, an oil other than the refrigerant oil or a high boiling component is present in the heat cycle system, it has adverse effects such as clogging of a vaporizer and an increase in the resistance of a rotating part.

The residue concentration in the heat cycle system is preferably at most 1,000 ppm, particularly preferably at most 100 ppm by the mass ratio based on the working fluid for heat cycle.

The residue may be removed by subjecting the working fluid for a heat cycle system to filtration through e.g. a filter. Further, the components (HFO-1123, HFO-1234yf and the like) of the working fluid for a heat cycle system may be separately subjected to filtration through a filter to remove the residue, before they are formed into a working fluid for a heat cycle system, and then the components are mixed to form a working fluid for a heat cycle system.

According to the above-mentioned heat cycle system, which employs a working fluid for heat cycle containing trifluoroethylene, practical cycle performance will be obtained while the influence over global warming is suppressed, and even if the self-decomposition reaction of HFO-1123 occurs, damages to the apparatus can be minimized.

Now, the constitution of the heat cycle system 10 to suppress damages when the self-decomposition reaction of trifluoroethylene contained in the working fluid occurs will be described. As shown in FIG. 1, the heat cycle system 10 comprises a fragile part 31. The fragile part 31 is provided in the circulation flow path 17 or to the condenser (the outdoor heat exchanger 14 or the indoor heat exchanger 12). Further, the fragile part 31 is provided preferably in the circulation flow path 17 connecting the condenser (the outdoor heat exchanger 14 or the indoor heat exchanger 12) and the expansion valve 15, or in the circulation flow path 17 connecting the compressor 20 and the condenser which is subjected to high pressure at the time of operation. In the heat cycle system 10 in FIG. 1, a four-way valve 16 which changes the direction of the flow of the working fluid 11 discharged from the compressor 20 is provided, and the fragile part 31 is provided in the circulation flow path 17 connecting the compressor 20 and the four-way valve 16. Particularly this portion is a portion at which the working fluid 11 has the highest temperature and the highest pressure in the circulation flow path 17 either at the time of cooling and at the time of heating, and the self-decomposition reaction is most likely to occur, and accordingly this portion is most preferred as a portion at which the fragile part 31 is provided. The pressure resistance strength of the fragile part 31 is lower than the pressure resistance strength of the circulation flow path 17 and the condenser. By such a constitution, even when the self-decomposition reaction of trifluoroethylene in the working fluid 11 occurs, the fragile part 31 is broken by a pressure increase in the circulation flow path 17 due to the self-decomposition reaction, and the working fluid 11 is quickly discharged to the outside from the broken fragile part 31. Thus, it is possible to avoid large-scale damages of the heat cycle system 10 due to the self-decomposition reaction of trifluoroethylene in the working fluid 11 thereby and to suppress damages.

According to Japanese Industrial Standard JIS B8620 (Safety code for small refrigerating equipment), the maximum allowable working pressure (for example, the saturation pressure of the working fluid at a temperature of 60° C.) of the working fluid in the heat cycle system is taken as the design pressure, and the pressure resistance strength of the heat cycle system is required to be at least 1.5 times the design pressure, and the pressure resistance strength of a pressure container such as a closed container of the compressor is required to be at least 3 times. The pressure resistance strength of the circulation flow path 17 or the condenser is preferably within a range of at least 1.5 times and at most 3 times the design pressure (the maximum pressure which allows the working fluid 11 to work) of the heat cycle system 10. Whereas the pressure resistance strength of the fragile part 31 is more preferably lower by from 10 to 30% than the pressure resistance strength of a part 17*a* on the upstream side and a part 17*b* on the downstream side of the circulation flow path 17, whereby the fragile part 31 can more securely be broken. As specific vales as examples, in a case where the working fluid is a mixed fluid of HFO-1123 (60 mass %) and HFC-32 (40 mass %), the design pressure (the saturation pressure at a temperature of 60° C.) is 4.6 MPa. The pressure resistance strength of the circulation flow path 17 and the condenser in this case is preferably at least 6.9 MPa and at most 13.8 MPa. Whereas, the pressure resistance strength of the fragile part 31 is preferably lower by from 10 to 30% than the pressure resistance strength of the circulation flow path 17 and the condenser. That is, the pressure resistance strength of the fragile part 31 is, taking the pressure resistance strength of the circulation flow path 17 and the condenser being 100%, preferably within a range of at least 70% and at most 90%.

Figure 3:
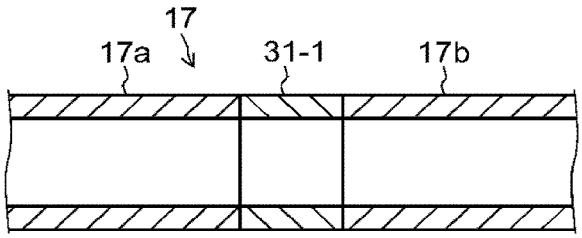
FIG. 3 is a cross-sectional view illustrating a fragile part provided in a circulation flow path of the heat cycle system in FIG. 1.

Now, specific structures of the fragile part 31 (after-described fragile part 31-1, fragile part 31-2, fragile part 31-3 and fragile part 31-4) will be described. First, the pressure resistance strengths of the circulation flow path 17 and the fragile part 31-1 will be described with reference to FIG. 3. As shown in FIG. 3, the fragile part 31-1 provided in the circulation flow path 17 is so constituted to have a pressure resistance strength lower than a part 17*a* on the upstream side and a part 17*b* on the downstream side as observed from the fragile part 31-1 in the direction of the flow of the working fluid. That is, the fragile part 31-1 is intentionally constituted to have lowered mechanical strength as compared with the other portion in the circulation flow path 17. As shown in FIG. 3, the fragile part 31-1 and the parts 17*a* and 17*b* on the upstream side and on the downstream side are bonded by soldering or brazing pipes having the same diameter and thickness. However, the fragile part 31-1 is preferably made from a constituent material having a tensile strength showing mechanical properties lower than that of the constituent material (constituent material of the part 17*a* on the upstream side and the part 17*b* on the downstream side) of the circulation flow path 17 in which the fragile part 31-1 is provided. Due to a difference in the tensile strength by the constituent materials, if the self-decomposition reaction of trifluoroethylene occurs in the circulation flow path 17, the fragile part 31-1 is broken by a pressure increase accompanying the self-decomposition reaction, and the pressure of the circulation flow path 17 is released to the outside from the broken part (pressure relief).

By the above-mentioned intensive pressure release part, it is possible to avoid large-scale breakages in the heat cycle system 10 if the self-decomposition reaction occurs. Further, if the fragile part 31-1 constituted by piping is subjected to an internal pressure, the stress which works in the circumferential direction is larger than in the radius direction of the piping, and properties in processing (influence by drawing) are also added, and in a case where the fragile part is to be broken, it is likely to have cracking in the axis direction, and the cracking expands all at once and leads to breakage. Thus, by the fragile part 31-1, the breakage points can be gathered, and damages by e.g. flying of broken members can be minimized.

Figure 4:
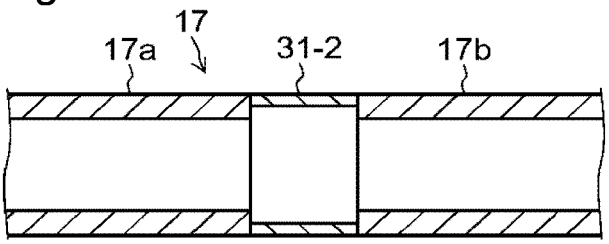
FIG. 4 is a cross-sectional view illustrating another fragile part having a structure different from that of the fragile part in FIG. 3.

FIG. 4 illustrates another fragile part 31-2 having a structure different from that of the fragile part 31-1. The fragile part 31-2 is constituted by the same material as the parts 17*a* and 17*b* on the upstream side and on the downstream side, as shown in FIG. 4. However, the fragile part 31-2 is so constituted to have a thickness smaller than the thickness of the circulation flow path (the part 17*a* on the upstream side and the part 17*b* on the downstream side) in which the fragile part 31-2 is provide, whereby the same effects as the fragile part 31-1 can be expected by a difference in the pressure resistance strength when subjected to an internal pressure.

Figure 5:
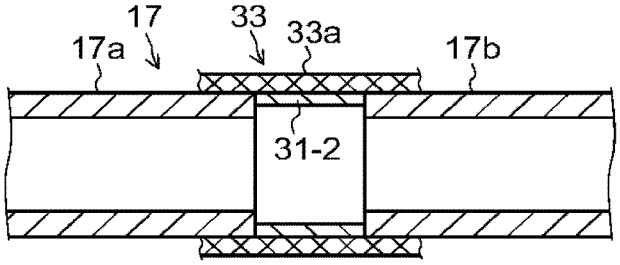
FIG. 5 is a cross-sectional view illustrating a protection part having a mesh-form member disposed on the outside of the fragile part in FIG. 4.

FIG. 5 illustrates a protection part 33 constituted to have a mesh-form member 33*a* disposed to the outside of the fragile part 31-2. The protection part 33 is to prevent broken pieces from flying when the fragile part 31-1, 31-2 or the like is broken to protect the surroundings. The mesh-form member 33*a* is required to prevent passage of the broken pieces and to have air permeability so as to release the internal pressure of the circulation flow path 17 as well. The mesh-form member 33*a* may be made of any material such as a metal material or a resin material so long as the air permeability is obtained. As mentioned above, the protection part 33 can prevent, when trifluoroethylene in the working fluid 11 undergoes the self-decomposition reaction in the circulation flow path 17, broken pieces of the fragile part 31-2 broken by the pressure generated by the self-decomposition reaction, from greatly flying to the outside of the circulation flow path 17.

Figure 6:
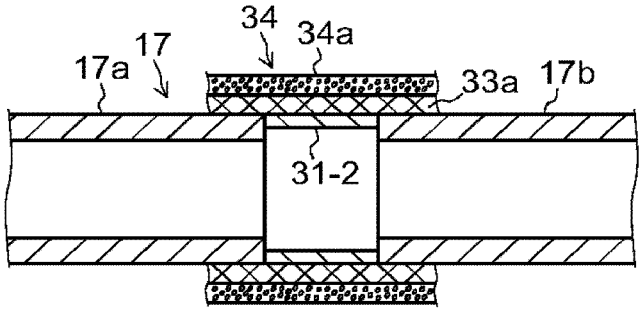
FIG. 6 is a cross-sectional view illustrating a protection part further having a porous adsorption member disposed on the outside of the mesh-form member in FIG. 5.

FIG. 6 illustrates a protection member 34 constituted to have a porous adsorption member 34*a* further disposed on the outside of the mesh-form member 33*a* in FIG. 5. The protection member 34 prevents broken pieces when the fragile part 31-1, 31-2 or the like is broken, fluid inorganic compounds in the circulation flow path 17, etc. from flying. As shown in FIG. 6, the porous adsorption member 34*a* which the protection part 34 has is a member to adsorb (capture) fluid inorganic compounds which may form in the circulation flow path 17, for example, hydrogen fluoride gas (HF). Accordingly, even when the fragile part 31-1, 31-2 or the like is broken, the protection part 34 can prevent hydrogen fluoride gas or the like in the circulation flow path 17 from flying to the outside.

Figure 7:
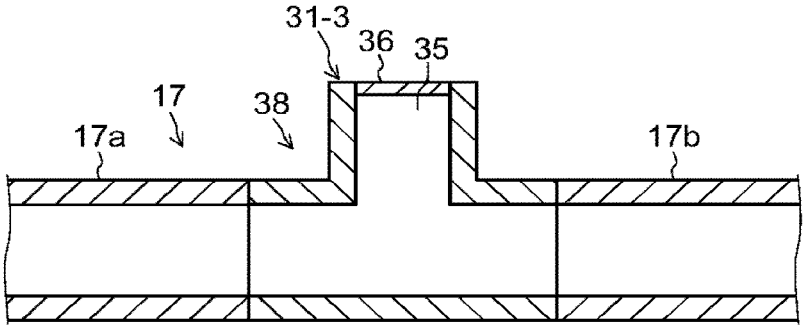
FIG. 7 is a cross-sectional view illustrating another fragile part having a structure different from those of the fragile parts in FIGS. 3 and 4.

FIG. 7 illustrates a T elbow (T joint) 38 having another fragile part 31-3 having a structure different from those of the fragile parts 31-1 and 31-2. As shown in FIG. 7, the fragile part 31-3 has an opening 35 and a cover 36 clogging the opening 35. The cover 36 is, as described for FIG. 3, constituted by a material having a pressure resistance strength lower than the parts 17*a* and 17*b* on the upstream side and on the downstream side, and is broken by a pressure generated when the working fluid undergoes the self-decomposition reaction. The difference from the fragile parts 31-1 and 31-2 is that the direction of the breakage is clear due to its shape (T elbow), whereby the breakage direction can be controlled, and further the accuracy of the pressure resistance strength can be stabilized, such being advantageous in production.

Figure 8:
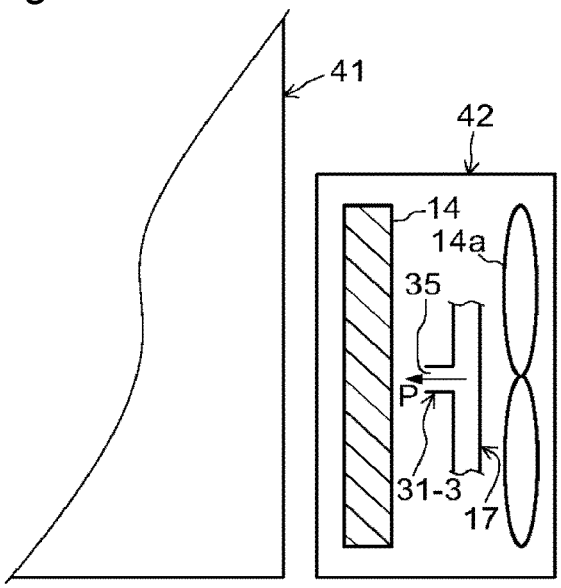
FIG. 8 is a view schematically illustrating the layout of the fragile part in FIG. 7.

Further, as shown in FIG. 8, the outdoor heat exchanger 14 (condenser at the time of cooling) and the fragile part 31-1 in the heat cycle system 10 are built into an outdoor unit 42 having an outdoor fan 14*a*. The fragile part 31-3 (an opening 35 when the fragile part 31-3 is broken) provided in the circulation flow path 17 is located selectively at a position facing the outdoor heat exchanger 14 which functions as a condenser (and at a position facing a house 41 to which the outdoor unit 42 is disposed). By such a structure, if trifluoroethylene in the working fluid undergoes the self-decomposition reaction, the fragile part 31-3 is instantaneously broken by the resulting pressure increase to release the pressure, and the resulting broken pieces fly to the outdoor heat exchanger 14 side or to the house 41 side. Thus, damages to cars and pedestrians in the roadway around the outdoor unit can be avoided. The fragile part is, from the safety viewpoint, preferably disposed only at a position facing the outdoor heat exchanger 14.

Figure 9:
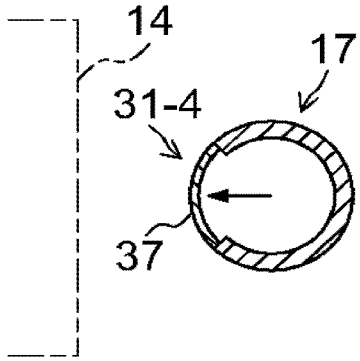
FIG. 9 is a cross-sectional view illustrating another fragile part having a structure different from those of the fragile parts in FIGS. 3, 4 and 7.

Further, as shown in FIG. 9, a fragile part 31-4 (a thin part 37 having a small thickness) provided in the circulation flow path 17 is located selectively at a position facing the outdoor heat exchanger 14 in the outdoor unit 42 (and at a position facing the house 41 to which the outdoor unit 42 is disposed), whereby the same effects as the fragile part 31-3 can be obtained. The fragile part is, from the safety viewpoint, preferably disposed only at a position facing the outdoor heat exchanger 14.

As described above, according to the heat cycle system 10 according to the present embodiment, damages when the self-decomposition reaction of trifluoroethylene contained in the working fluid occurs can be suppressed.

The present invention has been described with reference to the embodiments, however, the present invention is by no means restricted to such specific embodiments, and various changes and modifications are possible without departing from the intension and the scope of the present invention. For example, some constituents may be omitted from all the constituents disclosed in the embodiments, or a plurality of constituents disclosed in the embodiments may suitably be combined.

REFERENCE SYMBOLS

10: heat cycle system, 11: working fluid, 12: indoor heat exchanger (evaporator/condenser), 12*a*: indoor fan, 14: outdoor heat exchanger (condenser/evaporator), 14*a*: outdoor fan, 15: expansion valve, 16: four-way valve, 17; circulation flow path, 17*a*: part on the upstream side, 17*b*: part on the downstream side, 20: compressor, 21: closed container, 22*a*: motor stator, 22*b*: motor roller, 23: scroll compression mechanism, 24: accumulator, 25: suction pipe, 26: delivery pipe, 27: power supply terminal, 28: power supply path, 31, 31-1, 31-2, 31-3, 31-4: fragile part, 33, 34: protection part, 33*a*: mesh-form member, 34*a*: porous adsorption member, 35: opening, 36: cover, 37: thin part, 38: T elbow (T joint), 41: house, 42: outdoor unit.

This application is a continuation of PCT Application No. PCT/JP2018/015463, filed on Apr. 13, 2018, which is based upon and claims the benefit of priority from Japanese Patent Application No. 2017-083580 filed on Apr. 20, 2017. The contents of those applications are incorporated herein by reference in their entireties.

What is claimed is:

1. A heat cycle system which employs a working fluid containing trifluoroethylene, comprising:

a compressor, a condenser, an expansion valve and an evaporator;

a circulation flow path which connects the compressor, the condenser, the expansion valve and the evaporator and circulates the working fluid, and a fragile part, wherein the fragile part is provided in the circulation flow path or to the condenser and has a pressure resistance strength lower than the pressure resistance strength of each of the circulation flow path and the condenser, wherein the pressure resistance strength of the fragile part is within a range of at least 70% and at most 90% based on the pressure resistance strength of the circulation flow path and the condenser being 100%, and wherein the condenser and the fragile part are built into an outdoor unit, and the fragile part is disposed so that it is facing the condenser.

2. The heat cycle system according to claim 1, wherein the fragile part is provided in the circulation flow path connecting the compressor and the condenser or in the circulation flow path connecting the condenser and the expansion valve.

3. The heat cycle system according to claim 1, wherein the circulation flow path connecting the compressor and the condenser has a four-way valve, and the fragile part is provided in the circulation flow path connecting the compressor and the four-way valve.

4. The heat cycle system according to claim 1, wherein the fragile part is broken by a pressure generated when self-decomposition reaction of trifluoroethylene occurs in the circulation flow path to release the pressure to the outside of the circulation flow path.

5. The heat cycle system according to claim 1, wherein the pressure resistance strength of the fragile part is within a range of at least 1.5 times and at most 3 times the design pressure of the heat cycle system.

6. The heat cycle system according to claim 1, wherein the fragile part is made from a constituent material having a tensile strength lower than the constituent material of the circulation flow path.

7. The heat cycle system according to claim 1, wherein the thickness of the fragile part is smaller than the thickness of the circulation flow path.

8. The heat cycle system according to claim 1, which further has a protection part.

9. The heat cycle system according to claim 8, wherein the protection part has a mesh-form member.

10. The heat cycle system according to claim 8, wherein the protection part further has a porous adsorption member.

11. The heat cycle system according to claim 1, wherein the content of trifluoroethylene in 100 mass % of the working fluid is higher than 50 mass percent and at most 100 mass percent.

* * * * *